US006104266A

United States Patent [19]

Tilghman et al.

[11] Patent Number: 6,104,266

[45] Date of Patent: Aug. 15, 2000

[54] CIRCUIT BREAKER WITH TRIP INDICATION ARRANGEMENT

[75] Inventors: Douglas B. Tilghman, Bristol; Zhiqun Brenda Zhang, West Hartford; Frederic W. Glabau, Kensington; Raymond K. Seymour, Plainville; Kevin J. Fuhr, Goshen; Joseph Criniti, New Britain, all of Conn.

[73] Assignee: General Electric Company, Schenectady, N.Y.

[21] Appl. No.: 09/324,400

[22] Filed: Jun. 2, 1999

[51] Int. Cl.[7] ..... H01H 73/12

[52] U.S. Cl. ..... 335/17

[58] Field of Search ..... 335/17, 35, 42, 335/45, 167–172; 340/638–639

[56] References Cited

U.S. PATENT DOCUMENTS 3,401,363 9/1968 Vyskocil et al. ..... 335/17
3,443,258 5/1969 Durham et al. .
4,598,183 7/1986 Gardner et al. .
4,652,867 3/1987 Masot ..... 335/17
5,003,139 3/1991 Edds et al. .
5,089,796 2/1992 Glennon et al. .
5,694,101 12/1997 Lavell et al. .
5,831,500 11/1998 Turner et al. .

*Primary Examiner*—Lincoln Donovan
*Attorney, Agent, or Firm*—Carmody & Torrance LLP; Carl B. Horton

[57] ABSTRACT

A visible trip indication arrangement for a circuit breaker. The visible trip indication arrangement comprises a viewing window forming a part of the breaker housing, the viewing window including indicia thereon that is readily or enhancedly visible when the circuit breaker has been tripped and essentially not visible when the circuit breaker is operating by way of a trip indicator that moves under and aligns with the viewing window when the circuit breaker is in the tripped condition. The trip indicator having a brightly colored surface, causes the indicia on the viewing window to be readily visible by way of the reflected light off a surface thereof.

10 Claims, 3 Drawing Sheets

CIRCUIT BREAKER WITH TRIP INDICATION ARRANGEMENT

BACKGROUND OF THE INVENTION

The present invention relates generally to circuit breakers, and in particular, to an improved visible trip indication arrangement for a circuit breaker that more effectively indicates when the circuit breaker is in a tripped condition.

Circuit breakers which incorporate a visible indication that the circuit breaker has been tripped are known in the art. Two such examples are described in U.S. Pat. Nos. 3,443,258 and 3,401,363. Such indication is typically by way of coating or otherwise brightly coloring the trip flag with colored or fluorescent paint.

However, merely painting or coloring the trip flag does not effectively or clearly indicate to a user that the circuit breaker has in fact been tripped. Still further, if the flag is not accurately aligned with the window provided in the housing, the indication that the circuit breaker has tripped may not be readily noticed. A more effective circuit breaker construction that indicates that the circuit breaker has been tripped is desired.

To this end, it is desirable to provide an improved circuit breaker and visible trip indication arrangement that more clearly and effectively indicates when the circuit breaker has been tripped. The present invention disclosed herein achieves the aforementioned and below mentioned objectives.

SUMMARY OF THE INVENTION

Generally speaking, in accordance with the invention, a visible trip indication arrangement and circuit breaker incorporating same is provided. In the preferred embodiment, the circuit breaker includes a housing, a line terminal and a load terminal, and a circuit trip assembly within the housing. The circuit trip assembly electrically couples the line terminal and the load terminal when the circuit breaker is in a first (or operating) condition and electrically decouples the line terminal and the load terminal when the circuit breaker is in a second (or tripped) condition.

The visible trip indication arrangement preferably includes a viewing window or lens, that may form part of the housing. In particular, the lens may be a separate piece of plastic that is "slid," or otherwise mounted on the housing, or may be a piece of plastic that lies flush with and adhered to the housing during the manufacturing process. The viewing window includes indicia thereon that is enhancedly or more readily visible when the circuit breaker is in the second condition and essentially not visible when the circuit breaker is in the first condition. The trip arrangement also includes a trip indicator engageable with the circuit trip assembly, and movable from a first position when the circuit breaker is in the first condition to a second position when the circuit breaker is in the second condition, wherein when the circuit breaker is in the second condition, the trip indicator moves from its first position to its second position causing the indicia on the viewing window to be enhancedly or more readily visible.

Accordingly, it is an object of the present invention to provide a circuit breaker with an improved visible trip indication arrangement.

Another object of the present invention is to provide a circuit breaker with a visible trip indication arrangement that more effectively indicates when the circuit breaker is in the tripped condition.

Another object of the present invention is to provide a circuit breaker with a more effective visible trip indication arrangement that can be inexpensively manufactured.

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying figures, in which.

DETAILED DESCRIPTION OF THE PREFERRED EMBODIMENTS

Figure 1:
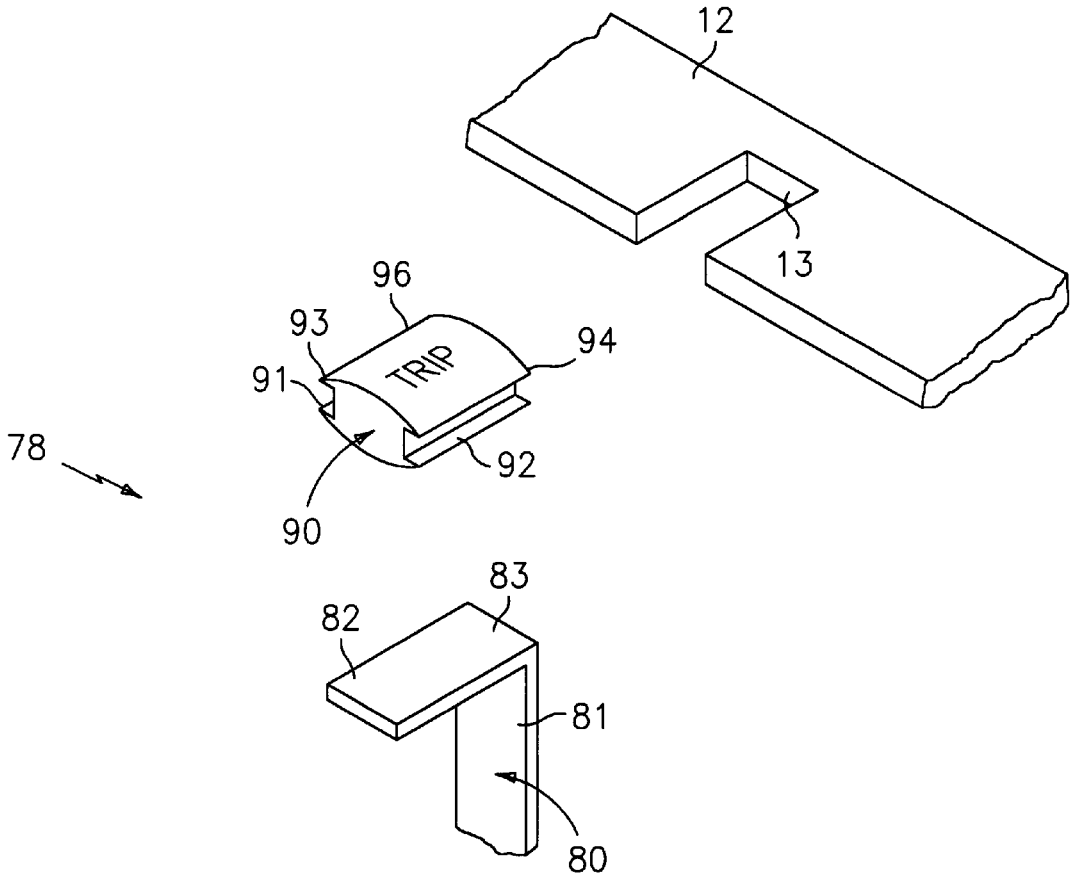
FIG. 1 is a perspective view illustrating the visible trip indication arrangement in accordance with the present invention.
Figure 2:
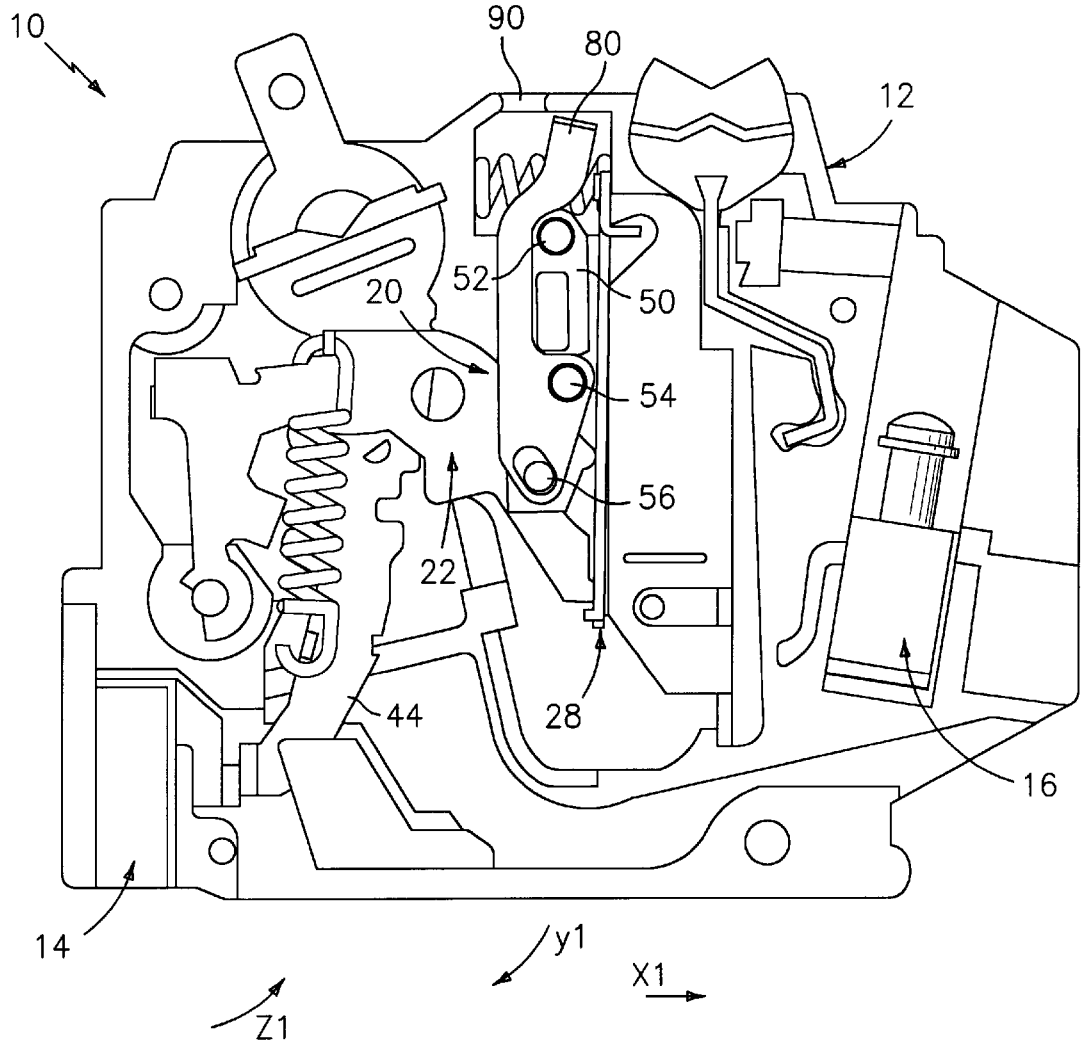
FIG. 2 is an internal elevational view of a portion of a circuit breaker in an operating condition, constructed in accordance with the present invention.
Figure 3:
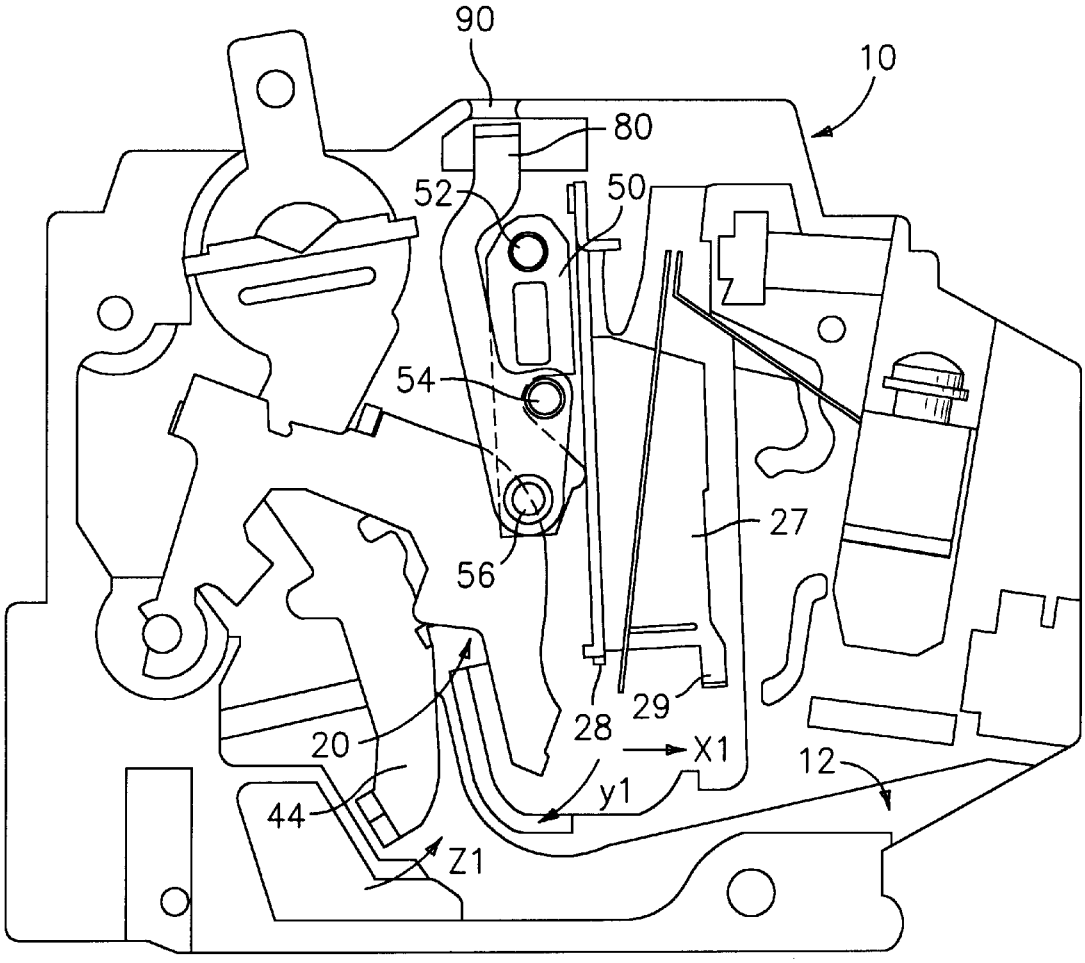
FIG. 3 is an internal elevational view of a portion of the circuit breaker in a tripped condition, constructed in accordance with the present invention.

Reference is generally made to FIGS. 1–3 wherein a circuit breaker, generally indicated at 10, is constructed in accordance with the present invention. It should be understood however, that certain features, such as the circuit trip assembly as disclosed below, is by way of example and not limitation, as it will be clear that the present invention, most specifically disclosed with reference to FIG. 1, is applicable to a wide range of general circuit breaker constructions, such as the preferred construction disclosed herein (FIGS. 2 and 3). Moreover, because many of the details of FIGS. 2 and 3 are not material to the present invention, only general references will be made thereto. For completeness however, details of the features not material to the present invention can be found in co-pending applications Ser. Nos. 09/196,647 and 09/211,242 which are assigned to the present assignee and incorporated by reference as if fully set forth herein. It should also be understood that the present invention can be adapted to be utilized with prior art circuit breaker constructions, as will be understood by one of skill in the art.

Generally speaking, as illustrated first with regard to FIGS. 2 and 3, a circuit breaker 10, constructed in accordance with the present invention is provided. Circuit breaker 10 includes a housing 12, a stab line terminal 14 and a stab load terminal 16 which may be fully or at least partially disposed within housing 12, and a circuit trip assembly 20 which electrically couples line terminal 14 and load terminal 16 when circuit breaker 10 is in a first (or operating) condition and electrically decouples line terminal 14 and load terminal 16 when circuit breaker 10 is in a second (or tripped) condition. Reference to a "second" condition can be initiated by a switch, such as in a test mode, as fully described in the aforementioned application Ser. No. 09/211,242.

FIG. 2 illustrates circuit breaker 10 in the first or operating condition while FIG. 3 illustrates circuit breaker 10 in the second or tripped condition. Generally speaking (again the details are omitted for simplicity), a circuit trip assembly, generally indicated at 20, may include a rotatable cradle generally indicated at 22, a rotatable arm 44 contactable with line terminal 14, a magnet 27, an armature latch 28, and a catch 29, the functions of which are all discussed at length in the aforementioned co-pending applications, along with additional details such as springs and other features for properly biasing the illustrated elements.

In the present invention, circuit trip assembly 20 also includes a trip cam 50 positioned intermediate cradle 22 and armature latch 28. As repeated herein for the convenience of the reader, upon a tripping condition, armature latch 28 moves in the "x1" direction, causing cradle 22 to disengage from armature latch 28 and rotate in a direction indicated by arrow "y1." Arm 44 likewise rotates in the direction of arrow "z1." Upon the rotation of cradle 22, a knee portion thereof will engage trip cam 50 so as to cause trip cam 50 to rotate about a pin 52. Upon the rotation of trip cam 50, a trip indicator 80, which is engageable with assembly 20 and constructed in accordance with the present invention as more particularly discussed below, rotates about a pin 54 on housing 12 from a first position (when circuit breaker was in the operating condition—FIG. 2) where trip indicator 80 was not aligned under a viewing window 90 (forming a part of housing 12) to a second position where trip indicator 80 is aligned under window 90 (FIG. 3). An aperture in the body of trip indicator 80 receives a guide pin 56 of trip cam 50. Guide pin 56 is provided to transfer the movement of trip cam 50 to trip indicator 80 to rotate trip indicator 80 about pin 54.

In this way, upon a simulated or real fault (i.e. trip) or test condition, the top portion of trip indicator 80 moves and is positionable under (window) lens 90 (FIG. 3). As also illustrated in FIG. 3, trip cam 50, cradle 22 and arm 44 are rotated so as to cause stab line terminal 14 to be electrically decoupled from stab load terminal 16.

As stated above, other trip assembly constructions such as those disclosed in the aforementioned application Ser. No. 09/196,647 can be employed as well. Therefore, reference to circuit trip assembly in the claims should not be understood in a limiting sense, since other constructions of a trip assembly will equally fall within the scope of the invention.

Referring now to FIG. 1 specifically, a visible trip arrangement, generally indicated at 78, constructed in accordance with the present invention, is illustrated. In the preferred embodiment, trip indicator 80 preferably includes an arm 81 and hand 82 integrally formed therewith. Hand 82 includes a top surface 83, extending essentially orthogonal from hand 82. Because of the plan view, this extending hand 82 is not easily illustrated in FIGS. 2 and 3, but present nonetheless.

As stated above, lens (or window) 90 provides a viewing window though which light can pass, and is preferably made from clear plastic. In accordance with the present invention, lens 90 includes indicia 96, such as the word "TRIP," preferably laser etched or molded on the upper surface thereof by conventional etching or molding techniques, although laser etching or molding on the lower surface thereof is also contemplated hereby. It should be understood that molding the indicia 96 on lens 90 provides for "raised" lettering, thereby providing the enhanced visibility as discussed below. Laser etching indicia 96 into lens 90 provides for contrasting color of the laser etched indicia also facilitating its visibility as disclosed below. Lens 90 includes respective right and left lower flanges 92, 91 and respective right and left upper flanges 94, 93. Lens 90 is disposed within a recess 13 formed within housing 12, with upper flanges 93, 94 and lower flanges 91, 92 assisting in securing lens 90 to the walls of housing 12. An adhesive or other bonding material can further assist in securing lens 90 within recess 13. Similarly, lens 90 can be formed to flushly fit within housing 12 by proper bonding or adhesive techniques readily known in the art. In this way, flanges 91, 92, 93, 94 may be unnecessary. A second housing half (not shown) is provided to secure the contents of the circuit breaker therein as well as to secure lens 90 within recess 13.

Surface 83 of trip indicator 80 is preferably brightly colored, such as by dipping or by painting. The coloring may also be of a florescent color. It will now be appreciated that as trip indicator 80 moves from its first position to its second position, trip indicator 80 will be essentially aligned under lens 90. In this position, ambient light passing through lens 90 is reflected off surface 83 of trip indicator 80. In this way, the visibility of indicia 96 is enhanced as light does not as easily pass through the indicia 96 thereby providing for the desired contrast. That is, indicia 96 is more readily visible when trip indicator 80 is in its second position. If indicia 96 is molded on lens 90, it is more distinctly, or similarly more enhancedly or readily visible when indicator 80 is in its second position by way of the light reflected back through lens 90.

However, when circuit breaker 10 is in its first condition wherein it is operating and the line and load terminals are electrically coupled by the circuit trip assembly 20, trip indicator 80 is not under nor aligned under lens 90 and the indicia etched or molded in lens 90 is essentially not visible or significantly less visible because sufficient light is not reflected off of surface 83.

It will thus be seen that the present invention makes it possible to provide an accurate and low cost circuit breaker construction with an improved visible trip arrangement that more effectively and accurately indicates when the circuit breaker has been tripped.

It is also to be understood that the following claims are intended to cover all of the generic and specific features of the invention described herein and all statements of the scope of the invention which as a matter of language might fall therebetween. For example, the terms rotatable or movable may be used interchangeably.

What we claim is:

1. A visible trip indication arrangement for a circuit breaker, wherein the circuit breaker comprises a housing, a line terminal and a load terminal, the line terminal and the load terminal disposed at least in part within the housing, and a circuit trip assembly within the housing, the circuit trip assembly at least for electrically coupling the line terminal and the load terminal when the circuit breaker is in a first condition and electrically decoupling the line terminal and the load terminal when the circuit breaker is in a second condition, the visible trip indication arrangement comprising:

a viewing window, the viewing window forming a part of the housing, the viewing window including indicia thereon; and a trip indicator coupled to the circuit trip assembly, the trip indicator movable from a first position when the circuit breaker is in the first condition to a second position when the circuit breaker is in the second condition, the trip indicator further comprising a surface off which light passing through the viewing window is reflected;

wherein when the circuit breaker is in the second condition, the trip indicator moves from its first position to its second position causing the indicia on the viewing window to be enhancedly visible by light reflected off the surface of the trip indicator.

2. The visible trip indication arrangement as claimed in claim 1, wherein the surface of the trip indicator has disposed thereon material comprised of paint.

3. The visible trip indication arrangement as claimed in claim 1, wherein the indicia is molded on the viewing window.

4. The visible trip indication arrangement as claimed in claim 1, wherein the indicia is laser etched into a surface of the viewing window.

5. The visible trip indication arrangement as claimed in claim 1, wherein the indicia is the word "TRIP."

6. A circuit breaker, the circuit breaker comprising:

a housing;

a line terminal and a load terminal each at least in part disposed within the housing;

a circuit trip assembly within the housing, the circuit trip assembly at least for electrically coupling the line terminal and the load terminal when the circuit breaker is in a first condition and electrically decoupling the line terminal and the load terminal when the circuit breaker is in a second condition;

a viewing window including indicia molded thereon; and a trip indicator coupled to the circuit trip assembly, the trip indicator being in a first position when the circuit breaker is in the first condition and movable to a second position when the circuit breaker is in the second condition, the trip indicator further comprising a surface off which light passing through the viewing window is reflected;

wherein when the circuit breaker is in the second condition, the trip indicator is in its second position causing the indicia on the viewing window to be enhancedly visible by light reflected off the surface of the trip indicator.

7. The circuit breaker as claimed in claim 6, wherein the surface of the trip indicator has disposed thereon material comprised of paint.

8. The circuit breaker as claimed in claim 6, wherein the indicia is the word "TRIP."

9. A circuit breaker, the circuit breaker comprising:

a housing;

a line terminal and a load terminal each at least in part disposed within the housing;

a circuit trip assembly within the housing, the circuit trip assembly at least for electrically coupling the line terminal and the load terminal when the circuit breaker is in a first condition and electrically decoupling the line terminal and the load terminal when the circuit breaker is in a second condition;

a viewing window including indicia laser etched into a surface of the viewing window; and a trip indicator coupled to the circuit trip assembly, the trip indicator being in a first position when the circuit breaker is in the first condition and movable to a second position when the circuit breaker is in the second condition, the trip indicator further comprising a surface off which light passing through the viewing window is reflected;

wherein when the circuit breaker is in the second condition, the trip indicator is in its second position causing the indicia on the viewing window to be enhancedly visible by light reflected off the surface of the trip indicator.

10. The circuit breaker as claimed in claim 9, wherein the indicia is the word "TRIP."

* * * * *